US006557570B1

(12) United States Patent
Gierbolini et al.

(10) Patent No.: US 6,557,570 B1
(45) Date of Patent: May 6, 2003

(54) PORTABLE APPARATUS FOR CLEANING A CONDUIT AND METHOD FOR CLEANING A CONDUIT

(75) Inventors: Luis Gierbolini, Lexington Park, MD (US); Dennis J. Goss, Morrisdale, PA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 223 days.

(21) Appl. No.: 09/704,381

(22) Filed: Nov. 2, 2000

(51) Int. Cl.[7] ..... B08B 9/032
(52) U.S. Cl. ..... 134/111; 134/169 C
(58) Field of Search ..... 134/111, 166 C, 134/169 C, 169 R, 169 A

(56) References Cited

U.S. PATENT DOCUMENTS

| | | | | |
|---|---|---|---|---|
| 1,756,410 A | * | 4/1930 | Wertz | 134/111 |
| 2,425,848 A | * | 8/1947 | Vawter | 134/111 X |
| 2,665,772 A | * | 1/1954 | Greer et al. | 134/169 A X |
| 3,094,998 A | * | 6/1963 | Gley | 134/166 C X |
| 3,951,185 A | * | 4/1976 | Bower et al. | 134/169 R X |
| 4,085,474 A | | 4/1978 | Murphy | |
| 4,229,852 A | | 10/1980 | Brobeck | |
| 4,423,622 A | | 1/1984 | Bartlett | |
| 4,784,170 A | * | 11/1988 | Romanelli et al. | 134/169 A X |
| 4,874,002 A | * | 10/1989 | Sundholm | 134/111 |
| 4,877,043 A | * | 10/1989 | Carmichael et al. | 134/111 X |
| 4,922,937 A | | 5/1990 | Bloch | |
| 5,109,880 A | * | 5/1992 | Booth | 134/111 X |
| 5,178,684 A | | 1/1993 | Hutchins, Sr. | |
| 5,415,190 A | * | 5/1995 | Ionescu | 134/169 A X |
| 6,263,889 B1 | * | 7/2001 | Flynn et al. | 134/111 X |

OTHER PUBLICATIONS

Synopsis of Nov. 13, 1997 Lake Grey Meeting, Memorandum dated Nov. 20, 1997.

* cited by examiner

*Primary Examiner*—Philip R. Coe
(74) *Attorney, Agent, or Firm*—Ron Billi; Mark Glut

(57) ABSTRACT

A portable apparatus cleaning a conduit including a housing, a filter and a pump. The filter is attached to the conduit to be cleaned and an aqueous solution reservoir, and is storable within the housing. The pump is attached to the aqueous solution reservoir, and to the conduit to be cleaned, and is storable within the housing. A method for cleaning a conduit, which includes connecting a power supply to a pump, connecting an aqueous solution reservoir to the pump, connecting a conduit to be cleaned to the pump, connecting the conduit to be cleaned to a filter, connecting the filter to the aqueous solution reservoir, running the pump for a specified period of time, disconnecting the aqueous solution reservoir from the pump and filter, connecting the pump and filter to a container of distilled water, and running the pump for at least one cycle.

14 Claims, 2 Drawing Sheets

PORTABLE APPARATUS FOR CLEANING A CONDUIT AND METHOD FOR CLEANING A CONDUIT

STATEMENT OF GOVERNMENT INTEREST

The invention described herein may be manufactured and used by or for the Government of the United States of America for governmental purposes without payment of any royalties thereon or therefor.

BACKGROUND

The present invention relates to an apparatus for cleaning a conduit, and a method for cleaning a conduit. More specifically, but without limitation, the present invention relates to a portable apparatus for cleaning an aircraft oxygen conduit and a method for cleaning an aircraft oxygen conduit.

It is desirable to keep conduits in apparatuses clean and free from contaminates. A conduit is a pipe, channel, tube or the like, for conveying a fluid (gas or liquid). In particular, but without limitation, an oxygen conduit is a conduit that conveys oxygen to aircraft crew, a cockpit area, manned areas of any type of vehicle (aircraft, ship, truck, tank, etc.), and the like. An oxygen conduit can also convey oxygen to an engine, a chamber, a machine, or the like that requires oxygen for operation or use. Oxygen conduits need to be kept clean and free from foreign substances. Oxygen conduits can build up contamination and/or foreign substances as a result of normal use, malfunction or poor/improper maintenance. Contaminated oxygen conduits can cause fires and/or contaminate the oxygen, resulting in severe injury or death.

In addition, many conduit cleaners utilize chemicals that contain cleaning agents that are incompatible with oxygen systems. If the cleaned conduit is not completely purged of the cleaning agent, the oxygen system may not function properly once the conduit is reinstalled. Such malfunctions can cause, for example, oxygen fires and explosions. In aircraft oxygen conduits, a contaminated conduit is a life threatening safety hazard affecting both pilots and aircrew.

The standards of the Department of Defense, National Aeronautical and Space Administration (NASA), National Fire Protection Agency, American Society for Testing Materials and the Society of Automotive Engineers all specify that the rigorous removal of organic and particulate contamination from oxygen and oxygen enriched handling equipment is absolutely necessary to prevent a fire hazard. Failure to thoroughly clean oxygen enriched handling equipment has resulted in catastrophic fires. Testing by NASA has demonstrated that, in the presence of an ignition source resulting from particulate contamination or organic material, many metals will burn in an oxygen-enriched atmosphere. Accompanying the fire hazard is the toxicity hazard associated with oxygen and oxygen enriched handling equipment used in providing life support functions. In addition, personnel could be injured from toxic residue remaining in life support equipment cleaned with a cleaning agent that was inadequate. In these instances, the cleaning agent either failed to remove toxic contaminants or it contained toxic contaminates that were not removed during the cleaning process.

Due to the Montreal Protocol Agreement of 1987, production of CFC-113 "Freon" solvent, a class I Ozone Depleting Substance, has ceased as of Jan. 1, 1996. CFC-113 was the preferred Navy cleaning agent for oxygen systems and oxygen conduits. It was therefore necessary to develop a new apparatus for cleaning an oxygen conduit and to develop a new method for cleaning oxygen conduits that is safe and easy to use.

In addition, conventional apparatuses for cleaning conduits are typically not portable and often are large, bulky and clumsy. Most apparatuses for cleaning a conduit require the work piece or conduit to be cleaned to be transferred to the apparatus for cleaning a conduit, which can be both inconvenient and time consuming.

For the foregoing reasons, there is a need for a portable apparatus for cleaning a conduit and method for cleaning a conduit that is portable and easy to use.

SUMMARY

Accordingly, the present invention is directed to a portable apparatus for cleaning a conduit, having a housing, a filter, and a pump. The filter is attached to a conduit to be cleaned, and is also attached to an aqueous solution reservoir. The pump is attached to a power supply, the aqueous solution reservoir, and the conduit to be cleaned. The filter and pump are storable within the housing.

The present invention is directed to a portable apparatus for cleaning a conduit that is portable with the ability to be easily transported. The portable apparatus for cleaning a conduit is also easy and inexpensive to manufacture. The portable apparatus for cleaning a conduit is easy to use, easy to assemble and disassemble.

It is an object of the invention to provide an apparatus for cleaning a conduit that may be brought on board an aircraft and brought into tight cockpits. It is another object of the invention to provide an apparatus for cleaning a conduit that may used by deployed military personnel.

It is an object of the invention to provide a portable apparatus for cleaning a conduit and method for cleaning a conduit that can use any aqueous solution, specifically one that does not utilize any materials that can be a fire hazard. It is another object of the invention to provide a method and apparatus that is environmentally safe and does not utilize any ozone depleting substances that other cleaners utilize. It is also an object of the invention to provide an apparatus and method that satisfies Environmental Protection Agency requirements.

It is also an object of the present invention to provide a portable apparatus for cleaning a conduit that can also include a cleaning solution, which can effectively clean oxygen conduits. It is a further object of the invention to provide an apparatus wherein the cleaning solution can be a liquid oxygen cleaning compound and water.

It is also an object of the invention to provide a portable apparatus for cleaning a conduit and method for cleaning a conduit that cleans oils, grease, particulate, contaminates, and the like from the inside of an conduit, specifically, but without limitation, from the inside of an oxygen conduit. Based on United States Navy requirements, the portable apparatus for cleaning a conduit and method for cleaning a conduit has been tested to effectively clean oxygen conduits close to 100%.

It is a further object to provide a portable apparatus for cleaning a conduit and method for cleaning a conduit that is compatible with an oxygen system.

DRAWINGS

These and other features, aspects and advantages of the present invention will become better understood with regard to the following description and appended claims and accompanying drawings where:

DESCRIPTION

Figure 1:
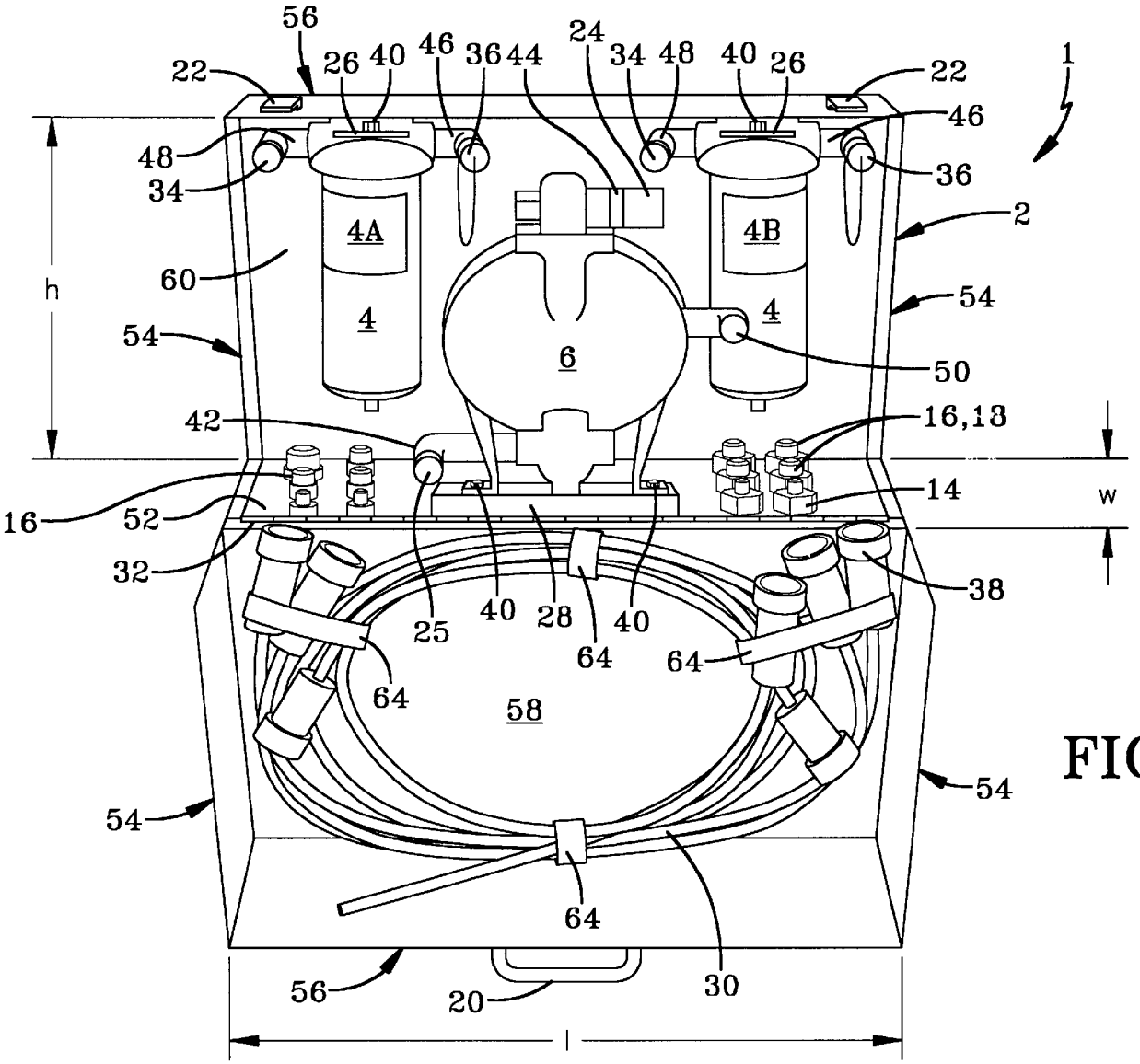
FIG. 1 shows a perspective view of the portable apparatus for cleaning a conduit, the apparatus is shown in the open position.
Figure 2:
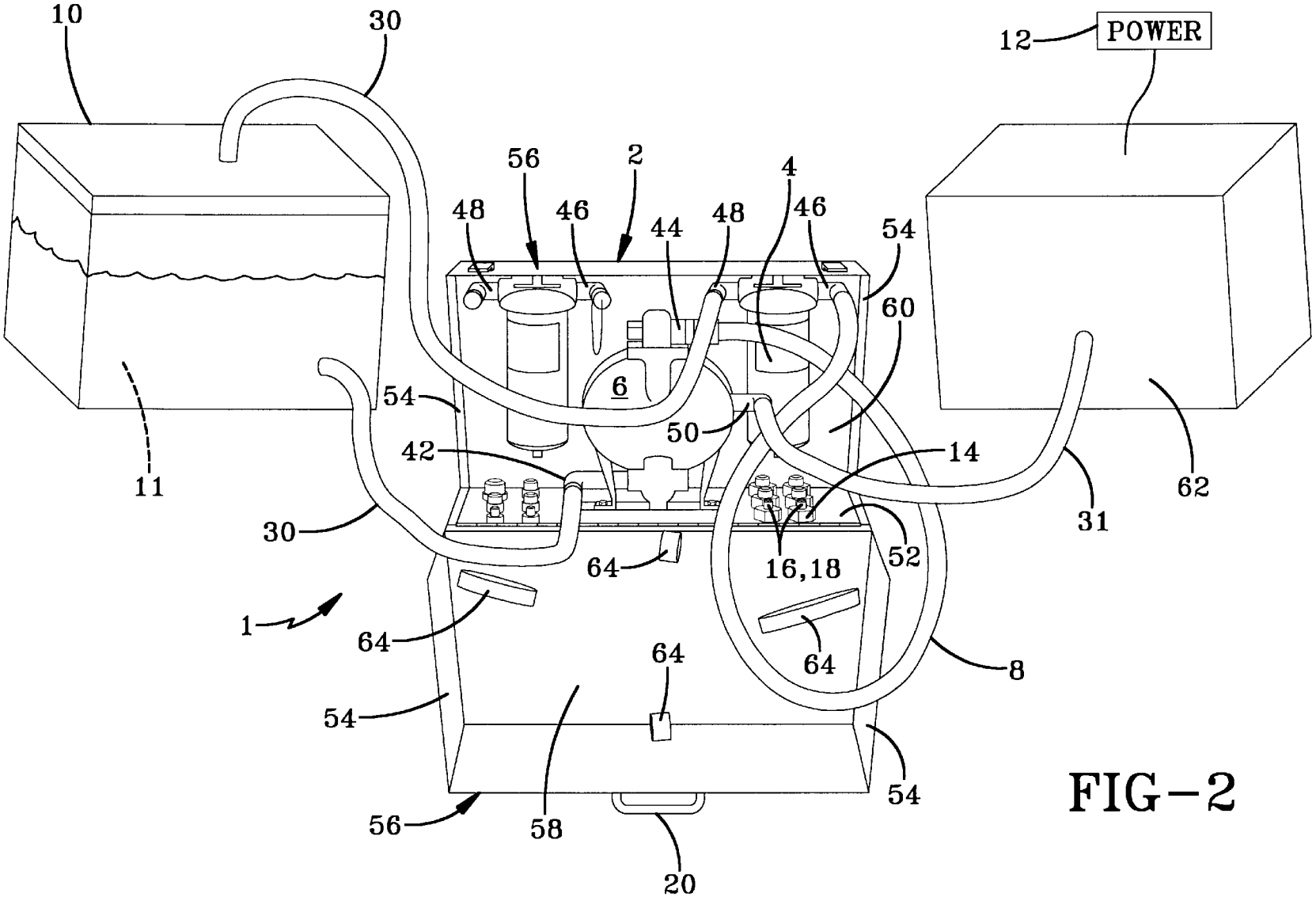
FIG. 2 shows a perspective view of the portable apparatus for cleaning a conduit in use.

The preferred embodiment of the present invention is illustrated by way of example in FIGS. 1 and 2. As shown in FIGS. 1 and 2, a portable apparatus for cleaning a conduit 1 includes a housing 2, a filter 4, and a pump 6. The filter 4 has a filter inlet 46 and a filter outlet 48. As shown in FIG. 2, the filter inlet 46 is removably attached to a conduit to be cleaned 8, and the filter outlet 48 is removably attached to an aqueous solution reservoir 10 with an aqueous solution II disposed within the aqueous solution reservoir 10. The pump 6 has a pump inlet 42 and a pump outlet 44. The pump 6 can be removably attached to an air adapter 62. A power supply 12 may be attached to the air adapter 62 and/or the pump 6. The power supply 12 supplies power so that the pump 6 and air adapter 62 can operate. The air adapter 62 removes moisture from the conduit to be cleaned 8 and the pump 6. As shown in FIG. 2, the air adapter 62 is removably attached to the pump 6 via a pump air adapter connector 31. The pump air adapter connector 31 attaches to the pump 6 via a pump air adapter inlet 50. The pump inlet 42 is removably attached to the aqueous solution reservoir 10. The pump outlet 44 is removably attached to the conduit to be cleaned 8. In operation, the pump 6 is for pumping aqueous solution 11 so that the aqueous solution 11 passes from the aqueous solution reservoir 10 through the pump 6, through the conduit to be cleaned 8 and through the filter 4, and back to the aqueous solution reservoir 10. The filter 4 and pump 6 are storable within the housing 2.

The filter 4, the pump 6, and the aqueous solution reservoir 10 can be attached to each other utilizing a series of connectors 30. As shown in FIG. 2, there is a connector 30 between the pump 6 and the aqueous solution reservoir 10, and a connector 30 between the filter 4 and the aqueous solution reservoir 10. The connector(s) 30 can be any type of connector, hose, apparatus that conveys fluid (gas or liquid), or the like. The connector(s) 30 provides fluid communication between the various components (pump, filter, aqueous solution reservoir, and the 10 like). Any devise that accomplishes this function may be used. The connector(s) 30 can be storable within the housing. The connector(s) 30 may be manufactured from rubber, plastic, metal, stainless steel, or the like. The connector(s) 30 may have connecting attachments at both ends so that the connector(s) 30 may be attached to the various components. The connecting attachments may be an interlocking thread configuration, a quick disconnect, a nut and thread, any type of connector, or the like. As shown in FIG. 1, in the preferred embodiment, the connector(s) 30 have at least one quick disconnect 38 attached such that connector(s) 30 can be attached quickly and easily to and from the components. As shown in FIGS. I and 2, the connector(s) 30 may be stored and removably fixed within the housing using a fastening configuration such as a fastening strap 64. The fastening strap 64 may be manufactured from leather, rubber, plastic, cloth, and the like. The fastening configuration may also be snaps, hooks, hold down, coupling, any fastening configuration, holders, or the like.

In the preferred embodiment, the housing 2 is manufactured from any sturdy material such as metal, metal alloy, aluminum, plastic, rubber, ceramic, or the like. The housing 2 can have a bottom portion 52, at least one side portion 54, a top portion 56, a front portion 58 and a back portion 60. The back portion 60, the front portion 58 and part of the side portions 54 may be removable. As shown in FIG. 1, the preferred embodiment of the housing 2 has at least two side portions 54 that are parallel to each other. In addition, in the preferred embodiment, when the apparatus is in the closed position the top portion 56 and bottom portion 52 are parallel to each other, while the front portion 58 and back portion 60 are also parallel to each other when the apparatus is in the closed position. In the preferred embodiment, the front portion 58 and back portion 60 are similar in shape and size and typically rectangular in shape. The two side portions 54 are also similar in shape and size and also are typically rectangular in shape. The top portion 56 and bottom portion 52 are also similar in shape and size and are typically rectangular in shape. The top portion 56 may be in two sections, a first top portion section that is permanently attached to the front portion 58 and a second top portion section that is permanently attached to back portion 60. The side portion(s) 54 can also be in two sections, with a first side portion section attached to the front portion 58 and a second side portion section attached to the back portion 60.

The housing 2 may contain a housing handle 20 for carrying. In the preferred embodiment, the housing handle 20 is located on the top portion 56 of the housing 2. The housing handle 20 may be located midway between the side portions 54 and midway between the front portion 58 and back portion 60 (when the apparatus is in the closed position).

As shown in FIG. 1, the housing 2 can also have the ability to open and close in a similar manner to a suitcase or briefcase. A housing closing hinge 32 can be located at the bottom portion 52 of the housing 2. The housing closing hinge 32 can also be located on the front portion 58 of the housing 2 such that when the housing 2 is in an open position and the back portion 60 of the housing 2 is vertical, and the bottom portion 52 or a part of the bottom portion 52 is horizontal. As shown in FIG. 1, the front portion 58 or part of the front portion 58 and/or part of the top portion 56 (the first top portion section) and/or part of the side portions 54 (the first side portion section) pivot on the housing closing hinge 32. The portions that pivot on the housing closing hinge 32 can be referred to collectively as a door. A door is a movable structure for opening or closing an entrance. Typically the door in the apparatus for cleaning a conduit 1 pivots in an upward and a downward motion. The door allows the user access to the components within the housing 2 and allows the user to operate the apparatus. This same embodiment can also be in operation when the apparatus is in the open position with the back portion 60 horizontal.

The housing 2 can have a closing devise 22 to prevent the housing 2 from opening during transport or when it is being stored. The closing devise 22 may be a latch, a pin, a lock, a clamp, a lug, a hook, a connector, a similar device, or the like. The closing devise 22 can be located on the top portion 56 of the housing 2 as shown in FIG. 1, or on any of the side portions 54 of the housing 2. As shown in FIG. 1, there also may be two closing devises 22.

As shown in FIG. 1, the housing 2 has a housing height (h), a housing length (1) and a housing width (w). The housing height (h) can be the distance between the top portion 56 and bottom portion 52 of the housing 2 when the apparatus is in the closed position. As shown in FIG. 1, the housing length (1) can be the distance between the side portions 54. The housing width (w) can be the distance between the front portion 58 and the back portion 60 of the housing 2 when the apparatus is in the closed position. In the preferred embodiment, the housing length (l) is in the range of about 22 to 24 inches, the housing height (h) is in the range of about 17 inches to 21 inches, and the housing width (w) is in the range of about 6 inches to 18 inches. It is preferred to minimize dimensions to allow the apparatus to be more portable and easier to handle.

The filter 4 can be a micron filter. A filter is a device or substance for straining out solid particles, impurities, etc. from a liquid or gas. As shown in FIGS. 1 and 2, the preferred embodiment of the portable apparatus for cleaning a conduit 1 has two filters, a cleaning filter 4A and a rinsing filter 4B. Both filters contain a filter inlet 46 and a filter outlet 48. The cleaning filter 4A is a filter that is used only for cleaning the conduit when using the aqueous solution 11. The rinsing filter 4B is a filter that is used only for rinsing the conduit after using the aqueous solution 11. The filter 4 can be attached within the housing 2 utilizing a fastener and can be demountable to allow the user to change filters. As shown in FIG. 1, the filter 4 can be attached to the housing 2 using a filter bracket support 26.

Filters commonly have a mesh size from about 1 micron to 200 microns or more. A filter with a mesh size of 2 microns is commonly referred to as a 2 micron filter. Filter mesh size measures the size of particles that can pass through a filter, thus the larger the filter mesh size the larger the particulates that could pass through the filter. The preferred filter 4 is from about a 2 micron filter to about a 5 micron filter. The filter 4 can further be a 3 micron glass filled, polypropylane/polyethyene foam type filter. The filter 4 can have filter caps 34 and/or filter plugs 36 to cover the filter inlet 46 and filter outlet 48. The filter 4 can be attached to the back portion 60 of the housing 2 or to the upper back portion 60 of the housing 2 or to the top portion 56 of the housing 2.

A pump is a machine that forces fluid (liquid or gas) into or out of something. A pump can draw out, pour forth, keep fluid moving, produce a flow, etc., and the like. In the preferred embodiment, the pump 6 is manufactured from stainless steel cast iron outside and stainless steel seals inside. The seals may be stainless steel with Teflon™. The pump 6 can be attached within the housing 2 utilizing a fastener and can be demountable to allow the user to change or repair the pump 6. As shown in FIG. 1, the pump 6 can be attached to the housing 2 using a pump bracket support 28. The pump 6 can have pump caps 24 and/or pump plugs 25 to cover the pump inlet 42 and pump outlet 44. As shown in FIG. 1, in the preferred embodiment the pump 6 is attached to the bottom portion 52 of the housing 2, approximately midway between the side portions 54. The pump 6 may also be midway between the back portion 60 and front portion 58 when the apparatus for cleaning a conduit 1 is in the closed position. As shown in FIG. 1, if there is a cleaning filter 4A and a rinsing filter 4B in the portable apparatus for cleaning a conduit 1, the pump 6 can be disposed between the two filters, which are each located in the upper corners of the housing 2.

The filter 4 and pump 6 (and bracket supports 26, 28) can be attached within or to the housing 2 (and to bracket supports 26, 28) using a component fastening devise 40. The component fastening devise 40 can be a bolt, cable, glue, clamp, connector, hook, latch, lock, lug, nail, nut, pin, rivet, screw, any type of fastening devise, or the like. The filter 4 and pump 6 can be demountable to allow the user to change them or for purposes of maintenance.

The portable apparatus for cleaning a conduit 1 can also have a set of fittings 14 and holders 16 to adapt to any size conduit to be cleaned 8. The fittings 14 are adapters that adjust to fit different size conduits and/or connectors. The fittings 14 allow any size conduit to be cleaned 8 or connector 30 to be attached to the appropriate inlet/outlet portions of the filter 4, pump 6 and any other component or devise. The fittings 14 change or adjust to allow attachment. The holders 16 hold and secure the fittings 14 in or on the housing 2 such that the fittings 14 may be easily demountable and not displaced during transport. The set of fittings 14 and holders 16 can be manufactured from any durable material such as metal, ceramic, metal alloy, any type carbon steel, vulcanized rubber, hard plastic, or the like. The holders 16 can be attached to the housing 2 by holder fasteners 18. The holder fasteners 18 can be any type of fastening devise such that the holders 16 are attached and/or secured to the housing 2. They may be attached anywhere inside the housing or outside the housing. They may be attached utilizing a bolt, clamp, hook, joint universal, latch, lug, pin, screw apparatus, or the like. As shown in FIG. 1, the holder fasteners 18 can be placed inside the housing and be aligned in manner such that the fittings 14 and holders 16 can be easily accessed without displacing any of the other components or taking apart the apparatus for cleaning a conduit 1. In particular, the fittings 14 and holders 16 can be disposed in the bottom portion 52 of the housing 2 interspersed between the other components. As also shown in FIG. 1, the holder 16 and holder fastener 18 can be one unit such as a screw, bolt, coupling, connection, dowel, any connecting type configuration, or the like.

A set of fittings 14 and holders 16 contains an amount of fittings 14 and corresponding holders 16 sufficient to run the apparatus. A set of fittings 14 and holders 16 can include at least six fittings 14 and corresponding holders 16 so that when the apparatus is in operation there are enough fittings 14 for each inlet/outlet or connection. The six fittings 14 include a fitting 14 that attaches the pump inlet 42 and a connector 30 attached to the aqueous solution reservoir 10, a fitting 14 that attaches the pump outlet 44 and the conduit to be cleaned 8, a fitting 14 that attaches the filter inlet 46 and the conduit to be cleaned 8, a fitting 14 that attaches the filter outlet 48 and another connector 30 attached to the aqueous solution reservoir 10, and two fittings 14 that attach the aqueous solution reservoir 10 and the two connectors 30.

In the preferred embodiment, the weight of the portable apparatus for cleaning a conduit 1 is in the range of about 30 to 125 pounds. The weight of the portable apparatus for cleaning a conduit 1 can be heavier or lighter depending on the type of material used.

The portable apparatus for cleaning a conduit 1 can also include an aqueous solution 11. The pump 6 pumps the aqueous solution 11 from the aqueous solution reservoir 10 so that it passes through the pump 6, through the conduit to be cleaned 8, through the filter 4, and then back to the aqueous solution reservoir 10. In the preferred embodiment, the aqueous solution 11 is a cleaning solution and is storable in the aqueous solution reservoir 10. The cleaning solution can be a water-based solution that mixes water and a liquid oxygen-cleaning compound. The cleaning solution should not contain any ChloroFluroCarbons. The preferred embodiment of the cleaning solution is a cleaning solution that can be about 50% water and about 50% liquid oxygen-cleaning compound. Furthermore, the liquid oxygen-cleaning compound can include sodium silicate and sodium tetrafluoroborate. The liquid oxygen-cleaning compound can have about 20 to 30 percent sodium silicate. The preferred liquid oxygen cleaning compound has a boiling point of 240 degrees Fahrenheit, complete solubility in water, a vapor density of 0.4 (where air is 1), and a specific gravity of 1.099. The liquid oxygen-cleaning compound also can be 85% volatile by volume. The preferred liquid oxygen-cleaning compound is OCC-RTC™, also known as Navy Oxygen Cleaner (NOC). NOC is an inorganic alkaline solution comprised of water, sodium silicate, molybdate and sodium fluoroborate. However, any aqueous solution can be used in this invention.

In the preferred embodiment, the method for cleaning a conduit, includes connecting a power supply 12 to a pump 6 having a pump inlet 42 and a pump outlet 44, connecting an aqueous solution reservoir 10 to the pump inlet 42, connecting a conduit to be cleaned 8 to the pump outlet 44. The conduit to be cleaned 8 is connected to a filter 4 having a filter inlet 46 and a filter outlet 48, specifically the conduit to be cleaned 8 is connected to the filter inlet 46. In the preferred embodiment, the filter 4 is a cleaning filter 4A with a cleaning filter inlet and cleaning filter outlet. The cleaning filter 4A is a filter specifically used in the step that utilizes an aqueous solution 11. The filter outlet 48 is connected to the aqueous solution reservoir 10. The aqueous solution reservoir 10 contains an aqueous solution 11. The pump 6 is then run for a specified period of time such that the aqueous solution passes from the aqueous solution reservoir 10 through the pump 6, through the conduit to be cleaned 8, through the filter 4, and back to the aqueous solution reservoir 10. The preferred time period for pumping the aqueous solution 11 is at least 30 minutes. The aqueous solution reservoir 10 is then disconnected from the pump inlet 42 and the filter outlet 48. The pump inlet 42 is then connected to a container of distilled water, and the conduit to be cleaned 8 is disconnected from the filter inlet 46 and placed to discharge into an empty container. The conduit to be cleaned 8 is then attached to the filter inlet 46, and the filter outlet 48 is attached to the container of distilled water. In the preferred embodiment, in this step the filter used is a rinsing filter 4B with a rinsing filter outlet and a rinsing filter inlet. A rinsing filter 4B is a filter that is specifically used in the step that utilizes distilled water. The pump 6 is then run for at least one cycle. One cycle represents one full revolution of the pump whereby the distilled water passes from the container of distilled water through the pump 6, through the conduit to be cleaned 8, through the filter 4 and back to the container of distilled water. At least five pump cycles is optimal.

The power supply 12 can be an air supply, an electric motor, a gas motor, a battery, any power-generating component, or the like. The preferred filter 4 is from about a 2 micron filter to a 5 micron filter. The filter 4 can further be a 3 micron glass filled, polypropylene/polyethylene foam type filter.

In the preferred embodiment, the aqueous solution 11 is a cleaning solution that can be a water-based solution that mixes water and a liquid oxygen-cleaning compound. The cleaning solution should not contain any ChloroFluroCarbons. The preferred embodiment of the cleaning solution is a cleaning solution that can be about 50% water and about 50% liquid oxygen-cleaning compound. Furthermore, the liquid oxygen-cleaning compound can include sodium silicate and sodium tetrafluoroborate. The liquid oxygen-cleaning compound can have about 20 to about 30 percent sodium silicate. The preferred liquid oxygen cleaning compound has a boiling point of 240 degrees Fahrenheit, complete solubility in water, a vapor density of 0.4 (where air is 1), a specific gravity of 1.099. The liquid oxygen-cleaning compound also can be 85% volatile by volume. The preferred liquid oxygen-cleaning compound is OCC-RTC™, also known as Navy Oxygen Cleaner (NOC). NOC is an inorganic alkaline solution comprised of water, sodium silicate, molybdate and sodium fluoroborate. Autogenous ignition testing of NOC results in no ignition at 493 degrees Celsius with an initial 100% oxygen pressure of 3000 psig. However, any aqueous solution can be used in this invention.

The container of distilled water and aqueous solution can be at a temperature range of about 32 degrees Fahrenheit to about 212 degrees Fahrenheit. At temperatures less than 32 degrees Fahrenheit, the water can freeze; at temperatures higher than 212 degrees the water can boil off. The preferred temperature range of the distilled water is about 150 to 160 degrees while the preferred temperature range of the aqueous solution is also about 150 to 160 degrees Fahrenheit.

In the preferred embodiment of the present invention, the water and aqueous solution should be pumped at a minimum velocity of about three (3) feet-per-second (fps). At fluid velocities of less than 3 feet per second, particulate redeposition may occur. The flow rate in gallons per minute (gpm) equivalent to 3 fps can be determined by multiplying the square of the pipe or tube inside diameter (ID) in inches times 7.4 such that: $GPM_{3fps}=(ID_{in})^2(7.4)$.

Although the present invention has been described in considerable detail with reference to certain preferred versions thereof, other versions are possible. Therefore, the spirit and scope of the appended claims should not be limited to the description of the preferred versions contained herein.

What is claimed is:

1. A portable apparatus for cleaning an oxygen conduit, the apparatus utilizing an aqueous solution reservoir, the apparatus comprising:

a.) a filter, the filter having a filter inlet and a filter outlet, the filter inlet removably attached to the conduit to be cleaned, the filter outlet removably attached to the aqueous solution reservoir;

b.) a pump for pumping aqueous solution from the aqueous solution reservoir through the pump, through the conduit to be cleaned and through the filter, the pump having a pump inlet and a pump outlet, the pump inlet removably attached to the aqueous solution reservoir, the pump outlet removably attached to the conduit to be cleaned, the pump removably attachable to an air adapter; and c.) a housing for storing the pump and filter, the filter being storable within the housing, and the pump being storable within the housing.

2. The portable apparatus for cleaning a conduit of claim 1, wherein the portable apparatus for cleaning a conduit has a weight between 30 to 150 pounds.

3. The portable apparatus for cleaning a conduit of claim 1, wherein the housing has a housing length, a housing height and a housing width.

4. The portable apparatus for cleaning a conduit of claim 3, wherein the housing length is between 22 to 24 inches.

5. The portable apparatus for cleaning a conduit of claim 3, wherein the housing height is between 17 to 21 inches.

6. The portable apparatus for cleaning a conduit of claim 3, wherein the housing width is between 6 to 18 inches.

7. The portable apparatus for cleaning a conduit of claim 1, wherein the housing is aluminum.

8. The portable apparatus for cleaning a conduit of claim 1, wherein the filter has a size from a 2 micron filter to a 5 micron filter.

9. The portable apparatus for cleaning a conduit of claim 1, further including a set of fittings and holders to adapt to any size conduit to be cleaned.

10. The portable apparatus for cleaning a conduit of claim 1, further including an aqueous solution, the aqueous solution further being a cleaning solution, the cleaning solution passing through the pump, through the conduit to be cleaned, and through the filter, the cleaning solution also being storable in the aqueous solution reservoir.

11. The portable apparatus cleaning a conduit of claim 10, wherein the cleaning solution is a liquid oxygen cleaning compound and water.

12. The portable apparatus cleaning a conduit of claim 11, wherein the liquid oxygen cleaning compound is comprised of sodium silicate and sodium tetrafluoroborate.

13. The portable apparatus cleaning a conduit of claim 12, wherein the sodium silicate has a concentration of 20% to 30% of the liquid oxygen cleaning compound.

14. A portable apparatus for cleaning an oxygen conduit, the apparatus using an aqueous solution, the aqueous solution comprising of sodium silicate, sodium tetrafluoroborate and about 50% water, the apparatus utilizing an aqueous solution reservoir with the aqueous solution disposed within the aqueous solution reservoir, the apparatus comprising:

a.) a filter, the filter having a filter inlet and a filter outlet, the filter inlet removably attached to the conduit to be cleaned, the filter outlet removably attached to the aqueous solution reservoir;

b.) a pump for pumping the aqueous solution from the aqueous solution reservoir through the pump, through the conduit to be cleaned and through the filter, the pump having a pump inlet and a pump outlet, the pump inlet removably attached to the aqueous solution reservoir, the pump outlet removably attached to the conduit to be cleaned, the pump removably attachable to an air adapter; and c.) a housing for storing the pump and filter, the filter being storable within the housing, and the pump being storable within the housing.

* * * * *